US008684569B2

(12) United States Patent
Pickard et al.

(10) Patent No.: US 8,684,569 B2
(45) Date of Patent: Apr. 1, 2014

(54) LENS AND TRIM ATTACHMENT STRUCTURE FOR SOLID STATE DOWNLIGHTS

(75) Inventors: Paul Kenneth Pickard, Morrisville, NC (US); Peter E. Lopez, Cary, NC (US)

(73) Assignee: Cree, Inc., Durham, NC (US)

( * ) Notice: Subject to any disclaimer, the term of this patent is extended or adjusted under 35 U.S.C. 154(b) by 98 days.

(21) Appl. No.: 13/176,827

(22) Filed: Jul. 6, 2011

(65) Prior Publication Data

US 2013/0010476 A1 Jan. 10, 2013

(51) Int. Cl.
*F21V 21/04* (2006.01)
*F21S 8/02* (2006.01)

(52) U.S. Cl.
USPC ..... 362/382; 362/365; 362/147

(58) Field of Classification Search
USPC ..... 362/374, 382, 452, 365, 311.02, 147, 362/148, 249.02
See application file for complete search history.

(56) References Cited

U.S. PATENT DOCUMENTS

| | | | | |
|---|---|---|---|---|
| 3,651,321 | A * | 3/1972 | Magi et al. | 362/455 |
| 6,435,691 | B1 * | 8/2002 | Macey et al. | 362/101 |
| 6,457,848 | B1 | 10/2002 | Wolf et al. | |
| 6,585,389 | B2 * | 7/2003 | Bonazzi | 362/147 |
| 7,399,104 | B2 * | 7/2008 | Rappaport | 362/365 |
| 8,337,055 | B2 * | 12/2012 | Clifton et al. | 362/362 |
| 8,376,592 | B2 * | 2/2013 | Engstrom et al. | 362/364 |
| 2005/0237746 | A1 | 10/2005 | Yiu | |
| 2007/0183154 | A1 | 8/2007 | Robson | |
| 2007/0253204 | A1 | 11/2007 | Akinrele et al. | |
| 2008/0137347 | A1 * | 6/2008 | Trott et al. | 362/311 |
| 2010/0110699 | A1 | 5/2010 | Chou | |
| 2011/0267834 | A1 * | 11/2011 | Potucek et al. | 362/551 |
| 2012/0106176 | A1 * | 5/2012 | Lopez et al. | 362/382 |
| 2012/0162994 | A1 * | 6/2012 | Wasniewski et al. | 362/294 |
| 2013/0051009 | A1 * | 2/2013 | Zaderej et al. | 362/235 |

FOREIGN PATENT DOCUMENTS

| | | | |
|---|---|---|---|
| KR | 10-2010-0102475 | A | 9/2010 |
| KR | 10-2011-0008796 | A | 1/2011 |
| WO | WO-2013/006239 | A2 | 1/2013 |

OTHER PUBLICATIONS

International Search Report and Written Opinion corresponding to International Patent Application No. PCT/US2012/040814 dated Dec. 26, 2012.

* cited by examiner

*Primary Examiner* — Peggy A. Neils
(74) *Attorney, Agent, or Firm* — Vincent K. Gustafson; Jenkins, Wilson, Taylor & Hunt, P.A.

(57) ABSTRACT

A lighting device such as a solid state downlight includes a lens structure with at least one integrally formed trim retaining element, and a trim structure including at least one lens structure engaging element, wherein the at least one lens structure engaging element is arranged to removably engage the least one trim retaining element, such as by rotating the trim structure. A generally cylindrical portion of the trim structure may be arranged to surround a central portion of the lens structure, thereby reducing or eliminating light piping and eliminating visible attachment elements for the trim structure.

26 Claims, 9 Drawing Sheets

LENS AND TRIM ATTACHMENT STRUCTURE FOR SOLID STATE DOWNLIGHTS

TECHNICAL FIELD

The present invention relates to lighting devices, and more particularly to lenses and reflector trim structures for lighting devices including solid state recessed lights or downlights.

BACKGROUND

A downlight (also called a recessed light or canister light or can light) is a light fixture that is installed in a ceiling, such that the light source is recessed above the plane of the ceiling. Various types of conventional fixtures utilize an incandescent Parabolic Aluminized Reflector (PAR) lamp or a compact fluorescent lamp as a light source. The light output may be concentrated in a narrow beam as a spotlight, or cast in a broader beam as a floodlight.

A conventional downlight includes a housing and/or light module (e.g., containing a lamp holder) that is generally recessed in a ceiling, and a trim structure including a thin lining around the edge of the light and arranged below the housing, wherein at least a portion of the trim structure is visible when a user looks upward into the fixture. At least a portion of a trim structure may have a truncated conical shape. In a typical downlight installation, the housing (or light module) is installed first, and the trim structure is installed thereafter. Trim structures may be reflective in character (e.g., polished metal), or may have colored surface finishes such as white or black.

Solid state (e.g., LED) downlights typically utilize lenses arranged between solid state emitters and trim structures. Current technology relies on externally accessible features and attachment processes such as screws, heat staking, adhesives, or snaps for attaching a lens and/or a trim structure to a housing and/or light module. To ensure that the trim is removable from the underside of an installed downlight, a non-illuminated area around the lens may be visible (thereby compromising aesthetic appearance of the fixture), or a portion of a trim attachment structure may block or obscure a portion of the lens in the direction of intended illumination (thereby compromising lighting performance). When complex lens structures are implemented in combination with diffuser films for LED color mixing in solid state downlights, vertically arranged structural elements can become problematic by "piping" light from around the diffuser film and into the illuminated space, showing an undesirable color separation to the user. It would be desirable to provide a solid state downlight trim attachment structure permitting the illuminated lens area to flow seamlessly to a (e.g., reflective) trim structure without visible mechanical attachment elements, without blocking light transmitted through the lens in the direction of intended illumination, while permitting the trim structure to be removably installed (preferably using little effort and without tools) from below the downlight. It would also be desirable to reduce undesirable light piping in solid state downlights. It would further be desirable to utilize conventional, low-cost manufacturing techniques for fabrication of lenses and trim structures to reduce fabrication difficulties and reduce production costs.

In consequence, the art continues to seek improved lens and trim structures for solid state downlights, as well as improved downlights including such structures and methods for fabricating same.

SUMMARY

The present invention relates to solid state lighting devices such as downlights, including a lens structure with at least one trim retaining element, and a trim structure including at least one lens structure engaging element, wherein the at least one lens structure engaging element is arranged to removably engage the least one trim retaining element.

In one aspect, the invention relates to a lens structure for a solid state lighting device, the lens structure comprising: a lower face, an upper face, at least one peripheral edge, and at least one recess defined in the lower face inboard of the at least one peripheral edge; and at least one trim retaining element arranged to retain an upper end portion of a trim structure when the upper end portion is fitted into the at least one recess.

In another aspect, the invention relates to a lens structure for a solid state lighting device and being arranged to cooperate with a trim structure that includes an open upper end, an open lower end, and at least one lens structure engaging element proximate to the open upper end, the lens structure comprising: a lower face, an upper face, and at least one peripheral edge, wherein at least a portion of each of the lower face and the upper face is arranged to transmit visible light; and at least one trim retaining element arranged to removably engage the at least one lens structure engaging element by rotation of the trim structure.

In a further aspect, the invention relates to a trim structure for a solid state lighting device and arranged to cooperate with a lens structure including at least one trim retaining element, the trim structure comprising: a body including an open upper end and an open lower end, wherein the open upper end has a width that is smaller than a width of the open lower end; at least one lens structure engaging element proximate to the open upper end, wherein the at least one lens structure engaging element is arranged to removably engage the least one trim retaining element by rotation of the trim structure.

A further aspect of the invention relates to a solid state downlight subassembly comprising: a lens structure including a lower face, at least one recess defined in the lower face, and at least one trim retaining element within the recess; a trim structure comprising (i) a body including an open lower end and an open upper end, wherein the open upper end has a width that is smaller than a width of the open lower end, and (ii) at least one lens structure engaging element proximate to the open upper end; wherein the open upper end is arranged for insertion into the at least one recess, and wherein the at least one lens structure engaging element is arranged to removably engage the at least one trim retaining element.

Yet another aspect of the invention relates to a solid state downlight subassembly comprising: a lens structure including a lower face, an upper face, and at least one peripheral edge, and at least one trim retaining element, wherein at least a portion of each of the lower face and the upper face is arranged to transmit visible light; a trim structure comprising (i) a body including an open lower end and an open upper end, wherein the open upper end has a width that is smaller than a width of the open lower end, and (ii) at least one lens structure engaging element proximate to the open upper end; wherein the at least one trim retaining element is arranged to removably engage the at least one lens structure engaging element by rotation of the trim structure.

A still further aspect of the invention relates to a method for engaging a trim structure having an open upper end and an open lower end to a downlight including a lens structure arranged to transmit light, the method comprising: arranging at least one lens structure engaging element of the trim structure proximate with at least one trim retaining element of the lens structure; and rotating the trim structure to removably engage the at least one lens structure engaging element with the at least one trim retaining element.

In another aspect of the invention, any of the foregoing aspects and/or any one or more aspects or features as disclosed herein may be combined for additional advantage.

Other aspects, features and embodiments of the invention will be more fully apparent from the ensuing disclosure and appended claims.

DETAILED DESCRIPTION

Figure 1:
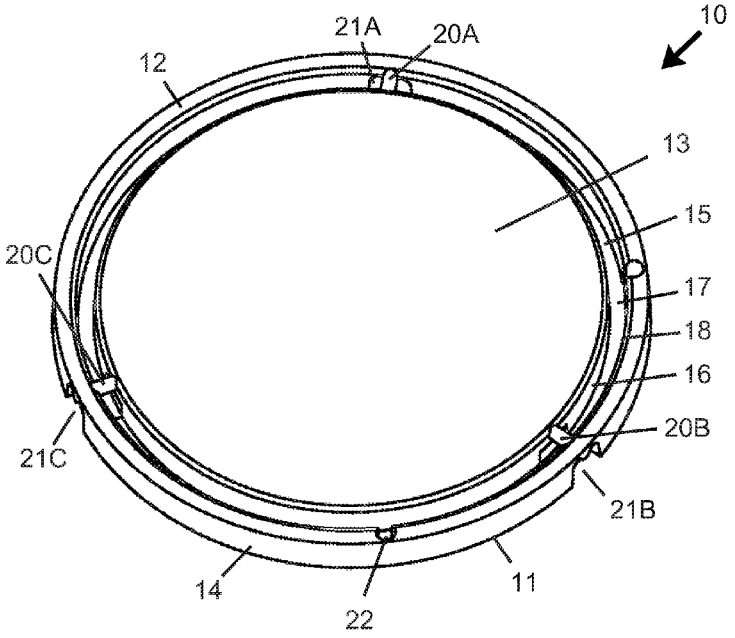
FIG. 1 is a perspective view of a first lens structure including multiple trim retaining elements for a solid state downlight lighting device according to at least one embodiment.

The present invention relates to solid state lighting devices such as downlights, including a lens structure with at least one trim retaining element, and a trim structure including at least one lens structure engaging element, wherein the at least one lens structure engaging element is arranged to removably engage the least one trim retaining element. The lens structure including the at least one trim retaining element is preferably integrally formed (e.g., via injection molding) from a single material, such that the at least one trim retaining element is part of the lens structure. The trim structure is preferably connected to the lens structure without intervening mechanical attachment elements (e.g., screws), without blocking light transmitted through a central (e.g., circular) portion of the lens structure in the direction of intended illumination. In certain embodiments, the at least one lens structure engaging element is arranged to removably engage the least one trim retaining element by rotation of the trim structure. Various other features are described herein.

As used herein, the singular forms "a," "an," and "the" are intended to include the plural forms as well, unless expressly stated otherwise. Unless the absence of one or more elements is specifically recited, the terms "comprising," "including," and "having" as used herein should be interpreted as open-ended terms that do not preclude the presence of one or more elements.

As used herein, the terms "upper" and "lower" are intended to refer to relative placement of elements or features when a resulting device or assembly is provided in a desired orientation. In certain embodiments directed to downlights arranged for placement in ceilings, the term "lower" may refer to an element or feature placed closer to a plane of a ceiling, and the term "upper" may refer to an element or feature placed above a corresponding "lower" element.

The terms "electrically activated emitter" and "emitter" as used herein refers to any device capable of producing visible or near visible (e.g., from infrared to ultraviolet) wavelength radiation, including but not limited to, xenon lamps, mercury lamps, sodium lamps, incandescent lamps, and solid state emitters, including diodes (LEDs), organic light emitting diodes (OLEDs), and lasers.

The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid state emitter depends on the materials of the active layers thereof. In various embodiments, solid state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near-white in character. In certain embodiments, the aggregated output of multiple solid state light emitters and/or lumiphoric materials may generate warm white light output having a color temperature range of from about 3000K to about 4000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Some embodiments of the present invention may use solid state emitters, emitter packages, fixtures, luminescent materials/elements, power supplies, control elements, and/or methods such as described in U.S. Pat. Nos. 7,564,180; 7,456,499; 7,213,940; 7,095,056; 6,958,497; 6,853,010; 6,791,119; 6,600,175, 6,201,262; 6,187,606; 6,120,600; 5,912,477; 5,739,554; 5,631,190; 5,604,135; 5,523,589; 5,416,342; 5,393,993; 5,359,345; 5,338,944; 5,210,051; 5,027,168; 5,027,168; 4,966,862, and/or 4,918,497, and U.S. Patent Application Publication Nos. 2009/0184616; 2009/0080185; 2009/0050908; 2009/0050907; 2008/0308825; 2008/0198112; 2008/0179611, 2008/0173884, 2008/0121921; 2008/0012036; 2007/0253209; 2007/0223219; 2007/0170447; 2007/0158668; 2007/0139923, 2006/0221272, 2011/0068696, and/or 2011/0068702; with the disclosures of each of the foregoing patents and patent application publications being hereby incorporated by reference as if set forth fully herein.

Although specific embodiments of the present invention relate to downlights, the invention is not necessarily limited to downlights, and various combinations of features and steps as disclosed herein may be applied to other lighting devices. The expression "lighting device," as used herein, is not limited, except that it is capable of emitting light. A lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge- or back-lighting (e.g., backlight poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting apparatus.

The present inventive subject matter further relates in certain embodiments to an illuminated enclosure (the volume of which can be illuminated uniformly or non-uniformly), comprising an enclosed space and at least one lighting device according to the present inventive subject matter, wherein the lighting device illuminates at least a portion of the enclosure (whether uniformly or non-uniformly).

The present inventive subject matter is further directed to an illuminated area, comprising at least one item, e.g., selected from among the group consisting of a structure, a swimming pool or spa, a room, a warehouse, an indicator, a road, a parking lot, a vehicle, signage (e.g., road signs), a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Various separate aspects as described herein are directed to inventive lens structures, trim structures, downlight subassemblies, downlights, and methods utilizing the foregoing items.

A lens structure as disclosed herein is preferably substantially transmissive of visible spectrum light, and is arranged to receive and transmit light from at least one electrically activated emitter (e.g., at least one solid state light emitter). In certain embodiments, a lens structure may have at least one associated diffuser, filter, and/or lumiphoric medium. In certain embodiments, a lens may be faceted in character. A lens may be arranged to produce a symmetrical or asymmetrical light output pattern. In various embodiments, a transmissive portion of a lens visible to a user may be round, elliptical, hemispherical, polygonal, or rectangular in shape.

A lens structure as described herein including at least one trim retaining element preferably formed of a single continuous material. Desirable fabrication processes for producing a lens element integrally formed of a single material include, but are not limited to, molding (e.g., injection molding) and machining. In certain embodiments, a lens element may be fabricated of a polymeric material, such as polycarbonate. In other embodiments, a lens element may be fabricated of glass. One or more surfaces of a lens may be textured or faceted.

In certain embodiments, a lens structure for a solid state lighting device includes a lower face, an upper face, at least one peripheral edge, and at least one recess defined in the lower face inboard of the at least one peripheral edge. At least one trim retaining element arranged to retain an upper end portion of a trim structure when the upper end portion is fitted into the at least one recess. In one embodiment, a solid state downlight includes the foregoing lens structure, a trim structure, and at least one electrically activated solid state emitter arranged to transmit light through at least a portion of the lens structure, wherein an upper end portion of the trim structure is retained by the at least one trim retaining element In certain embodiments, multiple trim retaining elements may be provided. At least a portion of each trim retaining element may be arranged within the at least one recess. In one embodiment, a recess is substantially annular in shape, and circumscribes or surrounds a central portion of a lower face the lens structure. The at least one trim retaining element is preferably arranged in non-overlapping relationship relative to (e.g., spaced laterally apart from) the circumscribed central portion in order to avoid blocking or obscuring light transmitted through the central portion of the lens.

In certain embodiments, a trim retaining element of a lens structure is adapted for tool-less engagement of a lens structure engaging element of a trim structure (i.e., to be performed by a user without requiring use of tools). In certain embodiments, at least one trim retaining element is arranged for selective engagement with the upper end portion of the trim structure by rotation of the trim structure.

One embodiment is directed to a method for engaging a trim structure having an open upper end and an open lower end to a downlight including a lens structure arranged to transmit light the method including: arranging at least one lens structure engaging element of the trim structure proximate with at least one trim retaining element of the lens structure; and rotating the trim structure to removably engage the at least one lens structure engaging element with the at least one trim retaining element. In certain embodiments, the at least one trim retaining element comprises multiple trim retaining elements, and the at least one lens structure engaging element comprises multiple lens structure engaging elements.

In certain embodiments, a lens structure for a solid state lighting device is arranged to cooperate with a trim structure as disclosed herein, and includes: a lower face, an upper face, and at least one peripheral edge, wherein at least a portion of each of the lower face and the upper face is arranged to transmit visible light; and at least one trim retaining element arranged to removably engage the at least one lens structure engaging element by rotation of the trim structure. In one embodiment, the at least one trim retaining element may include a radially extending post or pin arranged to fit into at least one slot proximate to the open upper end of the trim structure. In another embodiment, the at least one trim retaining element may include a first threaded surface of the lens structure arranged to cooperate with a second threaded surface proximate to the open upper end of the trim structure. In one embodiment, the lens structure may include at least one recess defined in the lower face inboard of the at least one peripheral edge, wherein at least a portion of the at least one trim retaining element is arranged in the at least one recess. In certain embodiments, multiple trim retaining elements of the lens structure may be arranged to cooperate with multiple lens structure engaging elements of a trim structure. In certain embodiments, the lower face, the upper face, the at least one peripheral edge, and the at least one trim retaining element of a lens structure are integrally formed of a single material. In one embodiment, a solid state downlight comprises the foregoing lens structure and a trim structure, with an upper end portion of the trim structure retained by the at least one trim retaining element. At least one electrically activated solid state emitter may be arranged to transmit light through at least a portion of the lens structure, wherein an upper end portion of the trim structure is retained by the at least one trim retaining element.

A trim structure as disclosed herein is arranged to cooperatively engage at least a portion (e.g., at least one trim retaining element) of a lens structure. In certain embodiments, a trim structure includes a body with an open upper end and an open lower end, wherein the open upper end has a width that is smaller than a width of the open lower end. In certain embodiments, a trim structure includes at least one lens structure engaging element proximate to the open upper end, wherein the at least one lens structure engaging element is arranged to removably engage the least one trim retaining element by rotation of the trim structure. A body portion of a trim structure may include a generally frustoconical (truncated conical) shape. In certain embodiments, an open lower end of a trim structure includes a protruding lip extending radially outward from the open lower end.

A trim structure as disclosed herein may be fabricated of any desirable material, such as spun metal (e.g., aluminum), cast metal, or any of various polymeric and/or composite materials. At least one interior surface of a trim structure may be reflective of visible spectrum light to reduce absorption of light by the trim structure and enhance transmission of light through a lighting device to an object or space to be illuminated.

In certain embodiments, at least a portion of an upper end of a trim element (e.g., a generally cylindrical portion) may be arranged to fit into the at least one recess defined in a lower surface of a lens structure, with the at least one recess circumscribing or surrounding a central portion of the lens structure. When fit into such a recess, a generally cylindrical portion may be arranged to substantially surround or fully surround the central portion of the lens structure, and thereby prevent any light penetrating peripheral portions of the lens structure from being transmitted through an interior portion of the trim structure. Such arrangement provides a transition from the a central lens portion of the lens structure to the trim structure that is visually seamless when viewed from below, and substantially eliminates undesirable light piping.

Trim retaining elements and lens structure engaging elements may include cooperative arrangements of male/female elements; protrusion/depression elements; one or more tabs, pins, or posts in combination with one or more slots, recessions, grooves, or apertures; and similar elements arranged for complementary engagement. In certain embodiments, a lens structure includes at least one trim retaining element in the form of one or more protruding or outwardly extending elements, and a corresponding trim structure includes at least one lens structure engaging element in the form of one or more recessions or openings arranged to receive the trim retaining element(s). In other embodiments, trim structure includes at least one lens structure engaging element in the form of one or more protruding or outwardly extending elements, and a corresponding lens structure includes at least one trim retaining element in the form of one or more recessions or openings arranged to receive the lens structure engaging element(s).

In certain embodiments, at least one trim retaining element (of a lens structure) includes a radially (outwardly) extending post or pin and arranged to fit into at least one slot defined in the upper end portion of the trim structure. In certain embodiments, a radially extending post or pin may extend outward from a peripheral edge of a lens element, or may be arranged within a recess defined in a lower surface of a lens element. Alternatively, a lens engaging element (of a trim structure) may including a radially inwardly extending post or pin arranged to fit into at least one slot, groove, or recess defined in a lens structure.

In certain embodiments, at least one trim retaining element comprises a first threaded surface of a lens structure (e.g., such as may be provided within a recess of a lens structure defined in a lower face thereof), and at least one lens structure engaging element of a trim structure comprises a second threaded surface arranged to mate with the first threaded surface.

Certain embodiments are directed to downlight (e.g., solid state downlight) subassemblies, and downlights (e.g., solid state downlights) including such subassemblies.

In certain embodiments, a downlight (e.g., solid state downlight) subassembly includes: a lens structure including a lower face, an upper face, and at least one peripheral edge, and at least one trim retaining element, wherein at least a portion of each of the lower face and the upper face is arranged to transmit visible light; and a trim structure comprising (i) a body including an open lower end and an open upper end, wherein the open upper end has a width that is smaller than a width of the open lower end, and (ii) at least one lens structure engaging element proximate to the open upper end; wherein the at least one trim retaining element arranged to removably engage the at least one lens structure engaging element by rotation of the trim structure. In certain embodiments, the at least one recess circumscribes a central portion of the lower face, the trim structure comprises a generally cylindrical portion proximate to the open upper end, and the generally cylindrical portion is arranged to substantially surround a central portion of the lower face. In one embodiment, a solid state downlight may include a downlight assembly as described above, and at least one electrically activated solid state emitter arranged to transmit light through at least a portion of the lens structure.

In certain embodiments, a downlight (e.g., solid state downlight) includes a lens structure including a lower face, an upper face, and at least one peripheral edge, and at least one trim retaining element, wherein at least a portion of each of the lower face and the upper face is arranged to transmit visible light; and a trim structure comprising (i) a body including an open lower end and an open upper end, wherein the open upper end has a width that is smaller than a width of the open lower end, and (ii) at least one lens structure engaging element proximate to the open upper end; wherein the at least one trim retaining element arranged to removably engage the at least one lens structure engaging element by rotation of the trim structure. In one embodiment, a solid state downlight may include a downlight assembly as described above, and at least one electrically activated solid state emitter arranged to transmit light through at least a portion of the lens structure.

Various features of lens structures, trim are described below in connection with FIGS. 1-11.

FIG. 1 is a perspective view of a first lens structure 10 including multiple trim retaining elements 20A-20C for a downlight according to at least one embodiment. The lens structure 10 includes an upper face 11, a lower face 12, and a peripheral edge 14. A recess 15 is defined in the lower face 11 proximate to (i.e., inboard of) the peripheral edge 14, with the recess 15 being bounded by an inner boundary wall 16, a lateral wall 17, and an outer boundary wall 18. Each trim retaining element 20A-20C comprises a pin or post within the recess 15 and extends from the inner boundary wall 16 to the outer boundary wall 18. An aperture 21A-21C is defined through the lateral wall 18 and a portion of the outer boundary wall 18 proximate to each trim retaining element 20A-20C. The recess 15 circumscribes (surrounds) a central lens portion 13 arranged to transmit light through the lens structure 10 and into the interior of a corresponding trim structure (such as the trim structure 30 illustrated in FIG. 2). A lower face of the central lens portion may optionally be substantially coplanar with the lower face 12. One or more optional registration features 22 may be provided along a peripheral portion of the lower face 12. The lens structure 10 is preferably integrally formed (e.g., via injection molding) from a single material, such that each trim retaining element 20A-20C is part of the lens structure 10.

Figure 2:
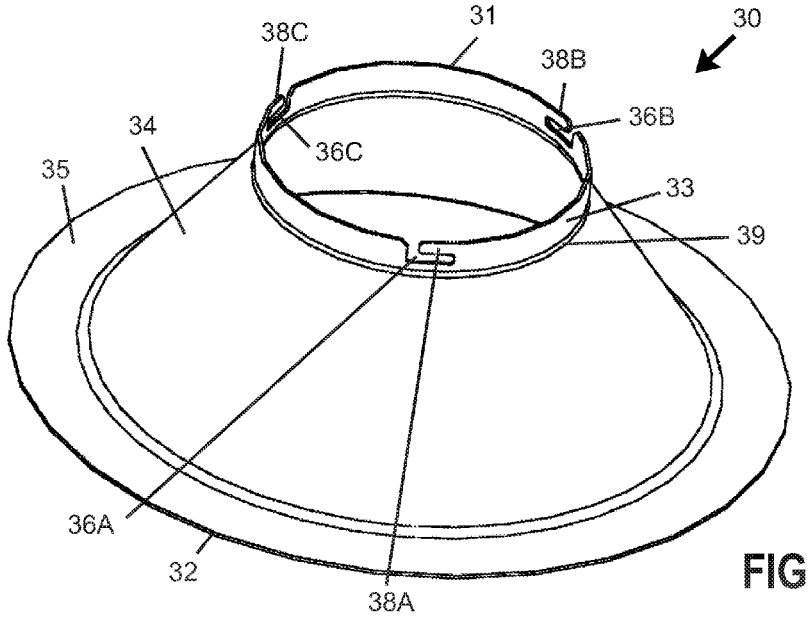
FIG. 2 is a perspective view of a first trim structure of a solid state downlight lighting device according to at least one embodiment, the trim structure including slots along a proximal end thereof arranged to cooperate with trim retaining elements arranged in the lens structure of FIG. 1.
Figure 3:
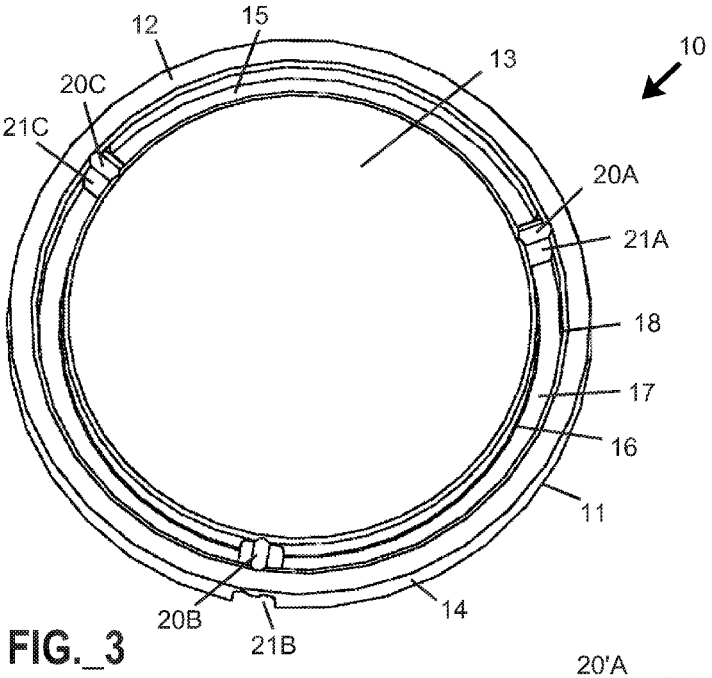
FIG. 3 is another perspective view of the first lens structure illustrated in FIG. 1.

FIG. 2 is a perspective view of a first trim structure 30 according to at least one embodiment, arranged to cooperate with the lens structure 10 of FIG. 1 or 3 as part of a downlight subassembly and/or a downlight. The trim structure 30 includes an open upper end 31, an open lower end 32, a generally cylindrical upper body portion 33, a frustoconical (truncated conical) body portion 34 meeting the upper body portion 33 at a transition 39, and a protruding lip 35 extending radially outward from the open lower end 31. Preferably, the open lower end 32 has a greater width than the open upper end 31. Although the trim structure 30 is illustrated as having a frustoconical body portion 34, it is to be appreciated that the body structure 34 may include compound angles and/or curved walls, and the angle(s) of the body structure 34 between the open upper end 31 and the open lower end 32 may be varied.

Proximate to the open upper end 31, the trim structure 30 includes slots 36A-36C defined in the cylindrical upper body portion 33, with the slots 36A-36C being bounded in part by circumferential tab portions 38A-38C along the open upper end 31. The trim structure 30 may be fabricated of spun metal, cast metal, or molded polymeric materials, among other potential material types and fabrication techniques.

FIG. 3 provides another perspective view of the lens structure 10 of FIG. 1, but with the optional registration features 22 being omitted.

Figure 4:
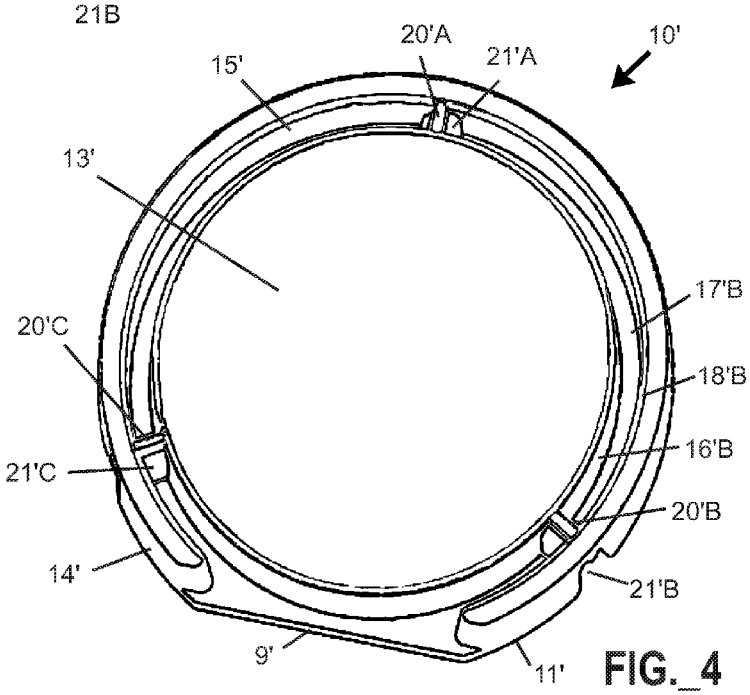
FIG. 4 is a perspective view of a second lens structure including multiple trim retaining elements for a solid state lighting device according to at least one embodiment.

FIG. 4 is a perspective view of a second lens structure 10' according to another embodiment. The lens structure 10' is substantially the same as the lens structure 10 illustrated in FIG. 3, except that the outer boundary wall 18' is discontinuous, terminating at a straight portion 9' of the peripheral edge. The lens structure 10' includes an upper face 11', a lower face 12', and a peripheral edge 14'. A recess 15' is defined in the lower face 11' proximate to (i.e., inboard of) the peripheral edge 14', with the recess 15' being bounded by an inner boundary wall 16', a lateral wall 17', and an outer boundary wall 18'. Each trim retaining element 20'A-20'C comprises a pin or post within the recess 15' and extends from the inner boundary wall 16' to the outer boundary wall 18'. An aperture 21'A-21'C is defined through the lateral wall 18' and a portion of the outer boundary wall 18' proximate to each trim retaining element 20A-20C'. The recess 15' circumscribes (surrounds) a central lens portion 13' arranged to transmit light through the lens structure 10' and into the interior of a corresponding trim structure (such as the trim structure 30 illustrated in FIG. 2).

Figure 5A:
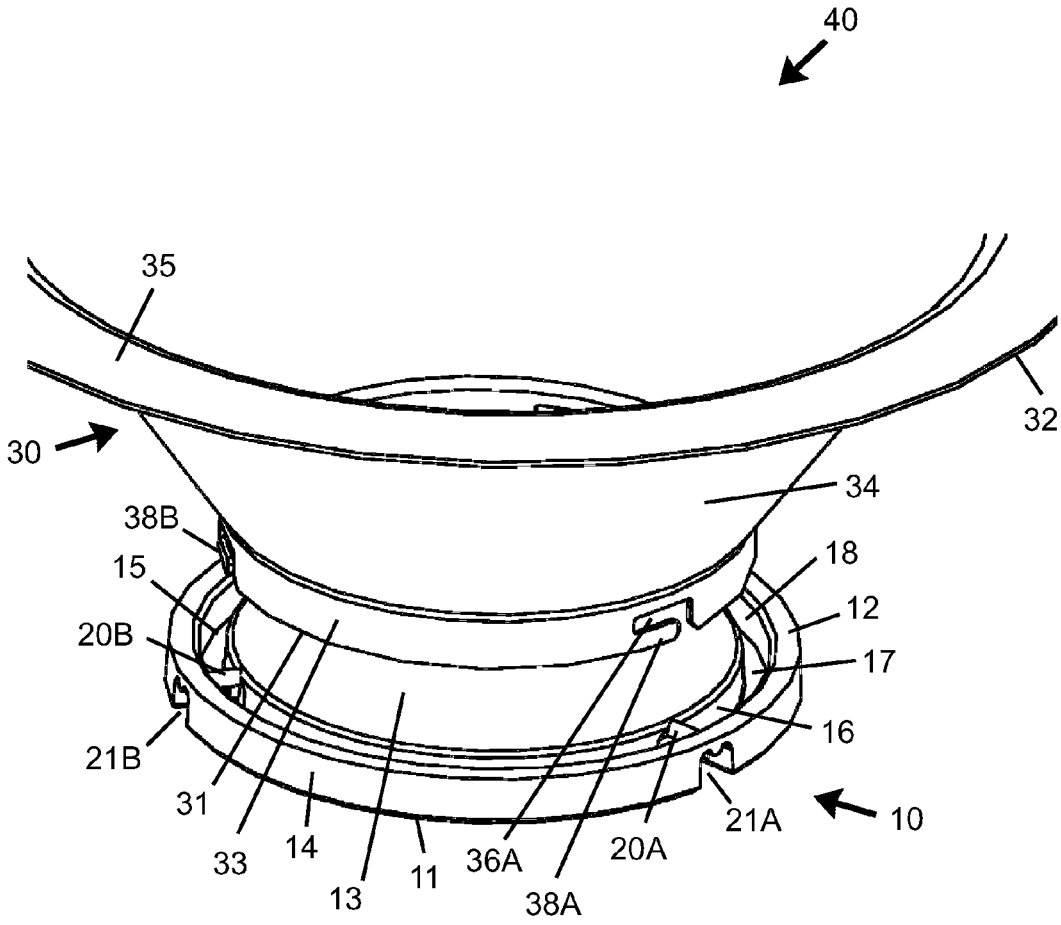
FIG. 5A is a perspective view of a portion of the first trim structure of FIG. 2 and the first lens structure of FIGS. 1 and 3 in a first state of assembly, with the trim structure and the lens structure being coaxially aligned, and with openings of the slots of the trim structure being arranged over the trim retaining elements of the lens structure.
Figure 5B:
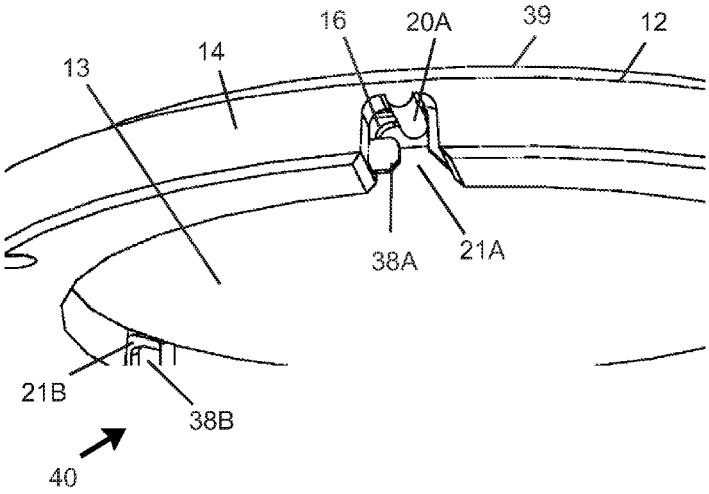
FIG. 5B is a perspective view of portions of the first trim structure of FIG. 2 and the first lens structure of FIGS. 1 and 3 in a second state of assembly, with an upper end of the trim structure being inserted into a recess defined by the lens structure, prior to rotation of the trim structure relative to the lens structure to accomplish locking therebetween (i.e., with the trim structure not locked to the lens structure).
Figure 5C:
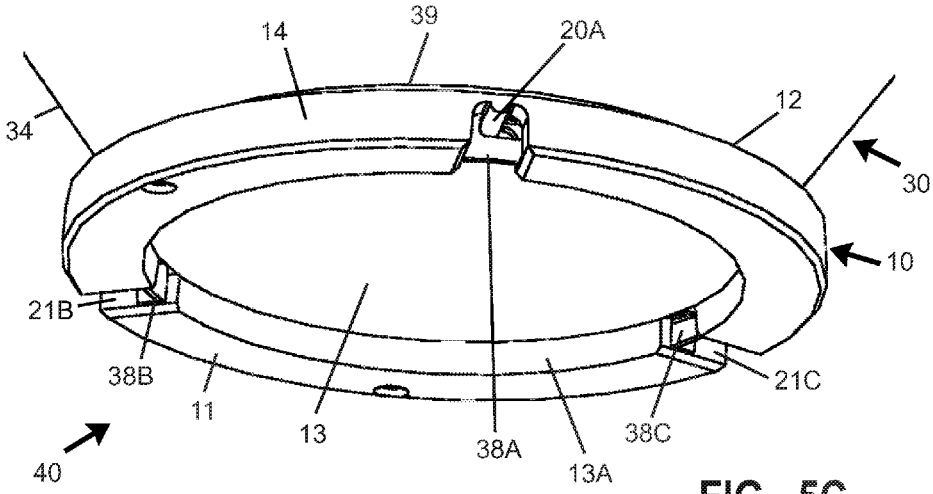
FIG. 5C is a perspective view of a portion of the first trim structure of FIG. 2 and the first lens structure of FIGS. 1 and 3 in a third state of assembly, with an upper end of the trim structure being inserted into a recess defined by the lens structure, and with the trim structure being locked to the lens structure (i.e., following rotation of the trim structure relative to the lens structure).

FIGS. 5A-5C provide perspective views of a lighting device subassembly 40 including a portions of the first trim structure 30 of FIG. 2 and the first lens structure 10 of FIGS. 1 and 3 in a three different state of assembly. FIG. 5A shows the trim structure 30 and lens structure 10 combination in a first state of assembly, with the trim structure 30 and the lens structure 10 being coaxially aligned, and with openings of the slots 36A-36C of the trim structure 30 being arranged over the trim retaining elements 20A-20C of the lens structure 10. FIG. 5B shows the trim structure 30 and lens structure 10 combination in a second state of assembly, with an upper end 31 of the trim structure 30 being inserted into the recess 15 of the lens structure 10, prior to rotation of the trim structure 30 relative to the lens structure 10 to accomplish locking therebetween. That is, the trim structure 30 and lens structure 10 are not locked together in FIG. 5B. Locking is accomplished by rotation of the trim structure 30 relative to the lens structure 10 to cause the circumferential tab portions 38A-38C to span across (e.g., over) the trim retaining elements 20A-20C. FIG. 5C shows the trim structure 30 and lens structure 10 combination in a first state of assembly, with an upper end 31 of the trim structure 30 being inserted into the recess 15 of the lens structure 10, and with the trim structure 30 being locked to the lens structure 10 (i.e., following rotation of the trim structure 30 relative to the lens structure 10). As shown in FIG. 5C, the lens structure 10 may include an inset portion 13A proximate to the central lens portion 13 along the upper face 11, such that an upper surface of the lens portion 13 may be arranged below the upper face 11.

Figure 11:
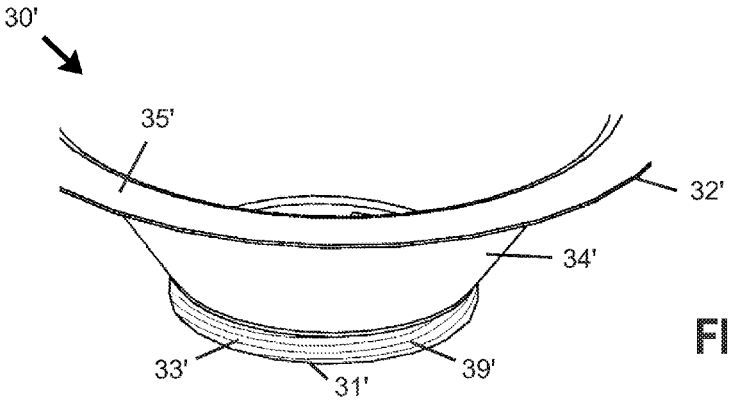
FIG. 11 is a perspective view of a portion of a third trim structure including a threaded surface along one end thereof.

Although the preceding figures illustrate slots 36A-36C as representing lens structure engaging elements, it is to be appreciated that any suitable types and combinations of trim retaining elements and lens structure engaging elements as described previously herein may be used. In certain embodiments, at least one trim retaining element comprises a first threaded surface of a lens structure, and at least one lens structure engaging element of a trim structure comprises a second threaded surface arranged to mate with the first threaded surface. For example, FIG. 11 illustrates a trim structure 30' according to one embodiment, with the trim structure including an open upper end 31', an open lower end 32', a generally cylindrical upper body portion 33', a frustoconical body portion 34' meeting the upper body portion 33' at a transition, and a protruding lip 35' extending radially outward from the open lower end 31'. The cylindrical body portion 33' includes a threaded surface 39' that may be arranged to mate with a corresponding threaded surface arranged in a recess (e.g., along an outer boundary wall) defined in a lower face of a lens structure. Although FIG. 11 shows the threaded surface 39' arranged along an exterior surface of the cylindrical body portion 33', in an alternative embodiment a threaded surface may be arranged along an interior surface of the cylindrical body portion and arranged to mate with a corresponding threaded surface arranged in a recess (e.g., along an inner boundary wall) defined in a lower face of a lens structure.

Figure 6:
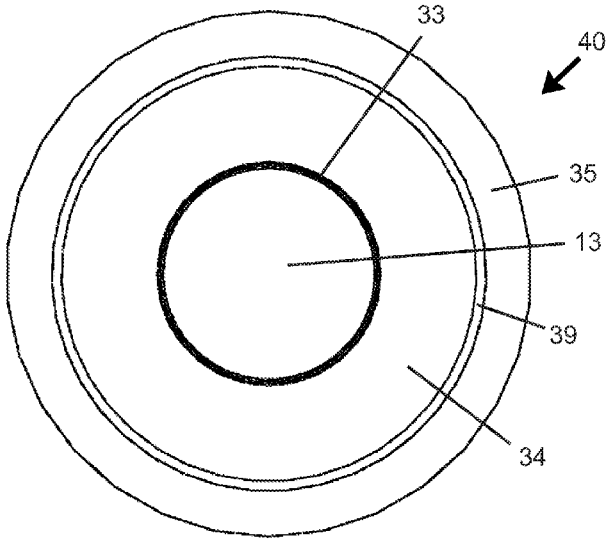
FIG. 6 a bottom elevation view of the first trim structure of FIG. 2 and the first lens structure of FIGS. 1 and 3, with the trim structure being locked to the lens structure (i.e., in accordance with FIG. 5C).

FIG. 6 a bottom elevation view of a subassembly 40 including the first trim structure 30 of FIG. 2 and the first lens structure 10 of FIGS. 1 and 3, with the trim structure 30 being locked to the lens structure 30 (i.e., in accordance with FIG. 5C). As shown in FIG. 6, with the cylindrical portion 33 inserted into the recess 15, the subassembly 40 provides a smooth transition from the a central lens portion 13 of the lens structure 13 to the trim structure 30 that is visually seamless when viewed from below.

Figure 7:
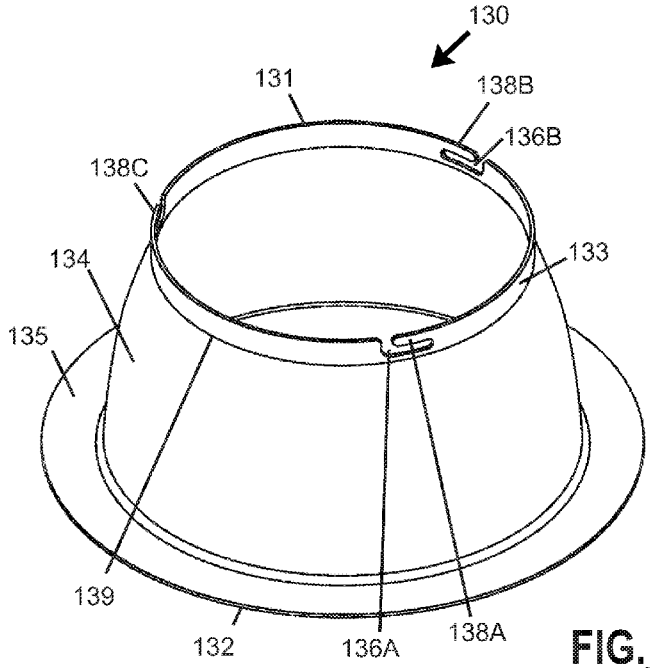
FIG. 7 is a perspective view of a second trim structure of a solid state lighting device according to at least one embodiment, the trim structure including slots along a proximal end thereof arranged to cooperate with trim retaining elements arranged in the lens structure of FIG. 1.

FIG. 7 is a perspective view of a second trim structure 130 of a lighting device according to at least one embodiment, the trim structure 130 being arranged to cooperate with the lens structure 10 of FIG. 1 or 3 as part of a downlight subassembly and/or a downlight. The trim structure 130 includes an open upper end 131, an open lower end 132, a generally cylindrical upper body portion 133, a tapered (e.g., generally frustoconical) medial body portion 134 meeting the upper body portion 133 at a transition 139, and a protruding lip 135 extending radially outward from the open lower end 131. Preferably, the open lower end 132 has a greater width than the open upper end 131. Proximate to the open upper end 131, the trim structure 130 includes slots 136A-136C defined in the cylindrical upper body portion 133, with the slots 136A-136C being bounded in part by circumferential tab portions 138A-138C along the open upper end 131. The trim structure 130 may be fabricated in the same manner as the trim structure 30.

Figure 8:
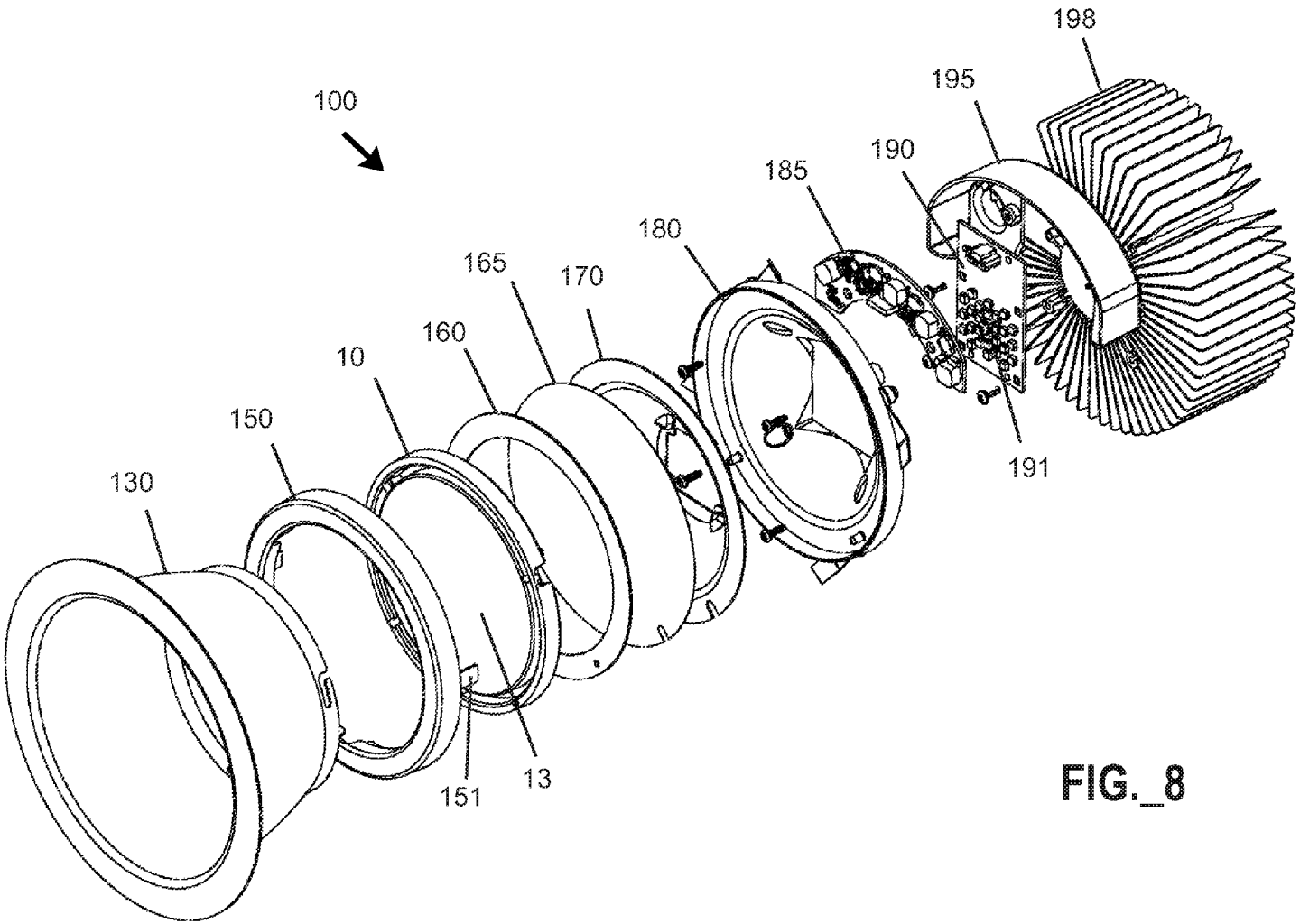
FIG. 8 is a perspective (exploded) assembly view of a solid state downlight lighting device including the second trim structure of FIG. 7 and the first lens structure according to FIGS. 1 and 3.

FIG. 8 is a perspective (exploded) assembly view of a solid state downlight lighting device 100 including the second trim structure 130 according to FIG. 7 and the first lens structure 10 according to FIG. 1. Starting at lower left, the lighting device includes the trim structure 130, a retention ring 150, the lens structure 10, the a gasket 160, a diffuser 165, a reflector cup 170, a main housing 180, a driver board 185, an emitter board 190 with associated solid state light emitters 191, a driver board housing 195, and a heatsink 198 arranged to dissipate heat generated by the solid state light emitters 191. The retention ring 150 is arranged to cover an edge portion of the lens structure 10 and to maintain the lens structure 10, gasket 160, diffuser 165, and reflector cup 170 in a sandwiched relationship when a tab portion 151 of the retention ring 150 is mated with the main housing 180 (such as shown in FIG. 10).

Figure 9A:
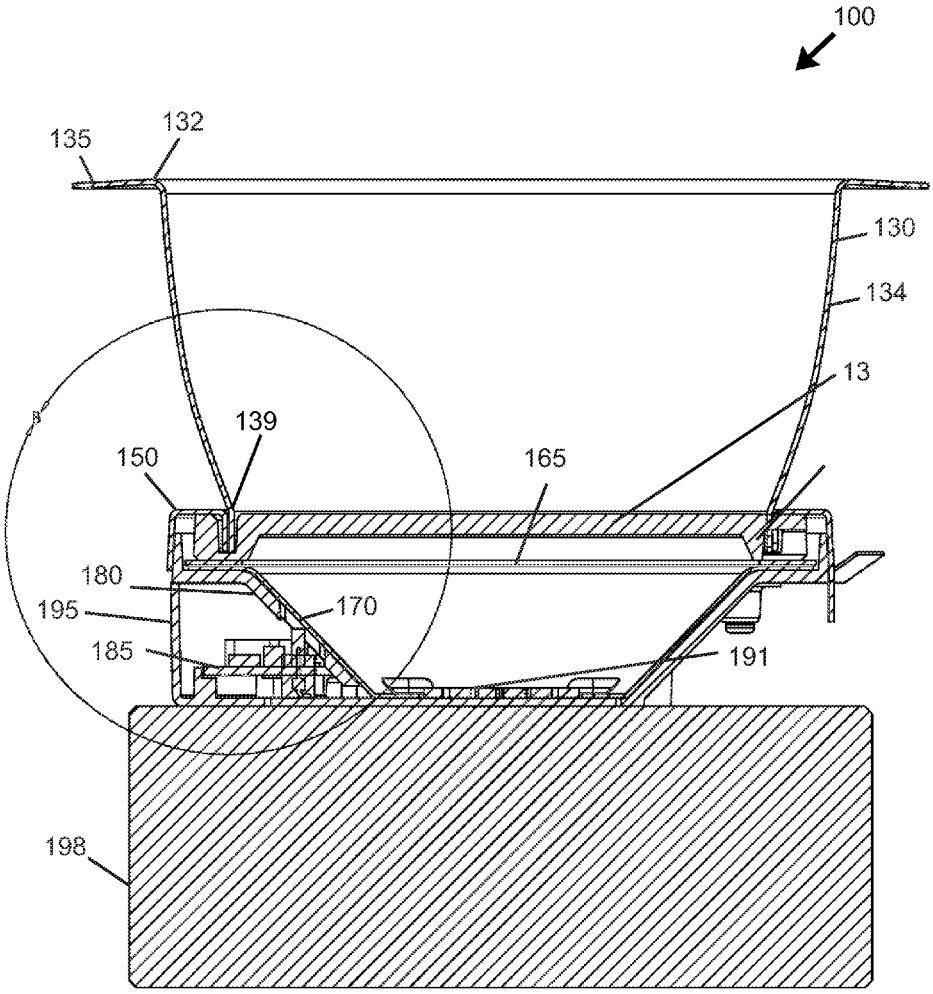
FIG. 9A is a side cross-sectional view of the solid state downlight lighting device of FIG. 8 in an assembled state.
Figure 9B:
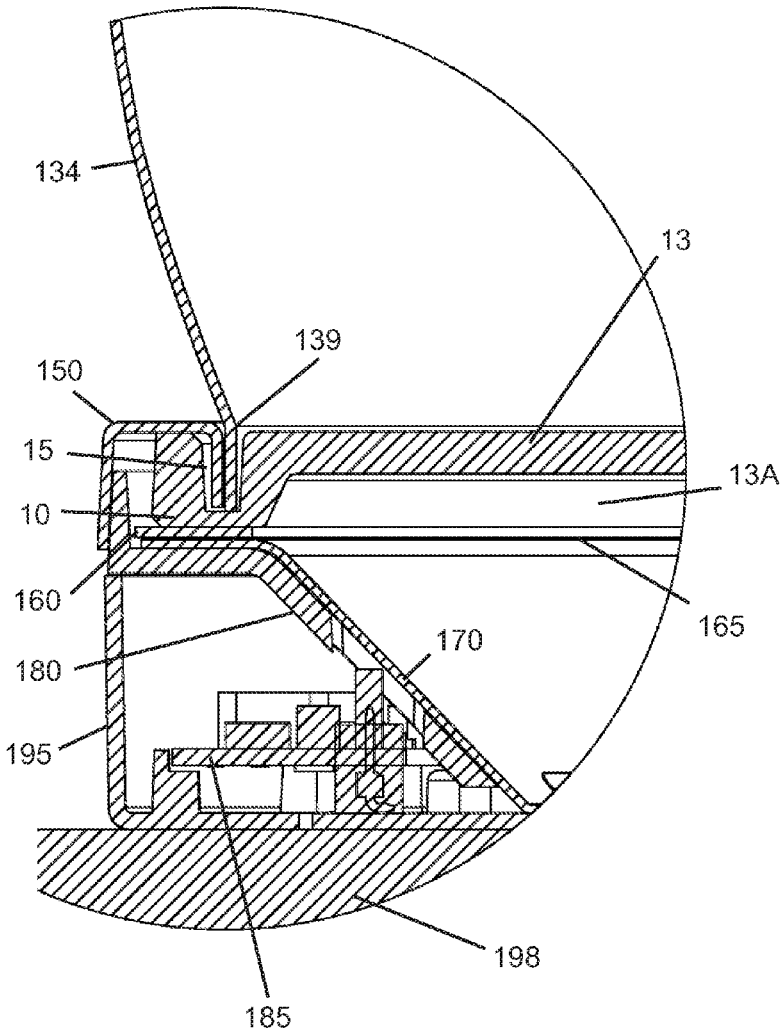
FIG. 9B is a magnified portion of the cross-sectional view of the lighting device of FIG. 9A, taken along detail circle "B" of FIG. 9A.
Figure 10:
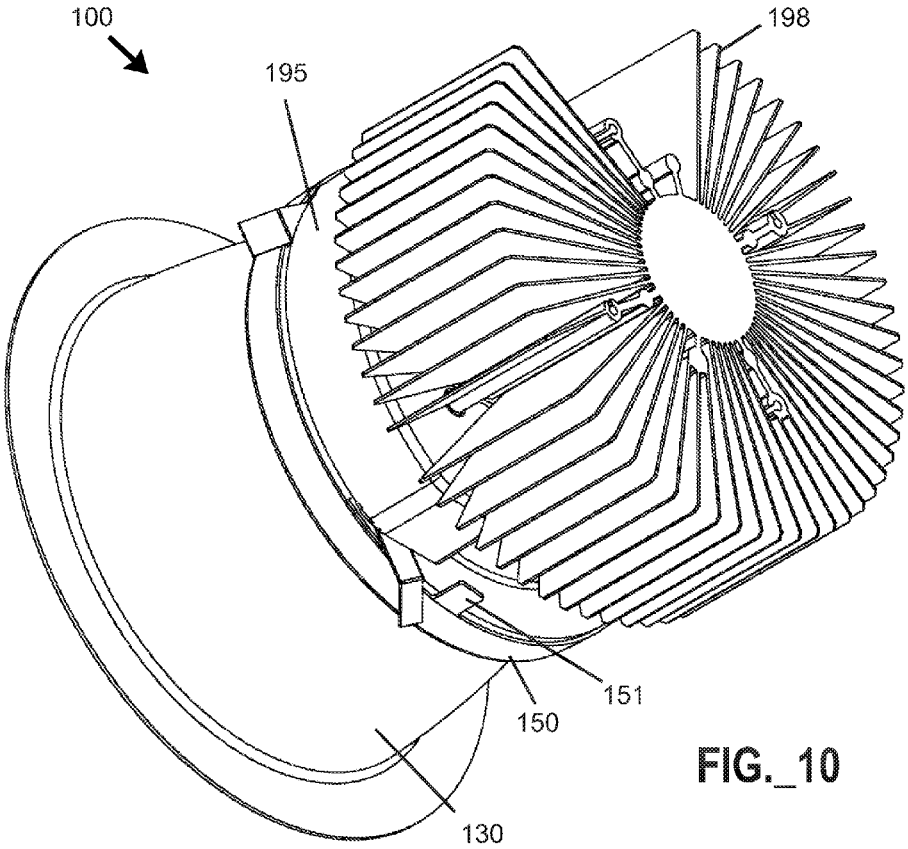
FIG. 10 is a perspective view of the solid state downlight lighting device of FIGS. 8 and 9A in an assembled state.

Various views of the assembled lighting device 100 are shown in FIGS. 9A, 9B, and 10. (It is noted that FIGS. 9A-9B illustrate the lighting device 100 in an upside-down state relating to a conventional installation, since the protruding lip 135 of the trim structure 130 would generally be the lowermost part of the lighting device 100 and the heatsink 198 would be the uppermost part of the lighting device 100 when installed in a typical ceiling.)

FIG. 9A is a side cross-sectional view of the lighting device 100, and FIG. 9B is a magnified portion of the lighting device of FIG. 9A, taken along detail circle "B" of FIG. 9A. As shown in FIGS. 9A-9B, both the cylindrical upper end 131 and an upper medial edge of the annular-shaped retention ring 150 are arranged to fit into the recess 15 defined in the lower face of the lens structure 10. Any light propagated within the lens structure 10 (laterally) beyond the central lens portion 13 is not permitted to escape the lighting device 100, since peripheral portions of the lens structure 10 are covered by the retaining ring 150, the gasket 160, and the main housing 180; moreover, the generally cylindrical portion 133 of the trim structure 130 is arranged to substantially surround or fully surround the central lens portion 13, further preventing any light penetrating peripheral portions of the lens structure 10 from being transmitted through an interior of the trim structure 10. As shown in FIGS. 9A-9B, the LED board 190 (with LEDs 191) is arranged in conductive thermal communication with the heatsink 198, and the reflector cup 170 is arranged to reflect light from the LEDs 191 toward the central lens portion 13. The diffuser 165 serves to diffuse light generated by the LEDs 191. Light transmitted through the diffuser 165 is further transmitted through the central lens portion 13 into an interior of the trim structure 130 to exit the lighting device through the open lower end 132.

Embodiments according to the present invention may provide one or more of various beneficial technical effects, including but not limited to the following: improved aesthetics of lighting devices by eliminating trim structure attachment elements visible to a user below a downlight; reduced or eliminated light piping effects with concomitant reduction of visible color separation; elimination of blocking of light transmitted through a downlight lens in the direction of intended illumination; reduction in effort and complexity in attaching a trim structure to a downlight; and reduction in lens and trim structure fabrication difficulties and production costs.

While the invention has been has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Correspondingly, the invention as hereinafter claimed is intended to be broadly construed and interpreted, as including all such variations, modifications and alternative embodiments, within its spirit and scope.

What is claimed is:

1. A lens structure for a solid state downlight and arranged for placement between at least one solid state emitter of the solid state downlight and a trim structure, the lens structure comprising:

a lower face, an upper face, at least one peripheral edge, and at least one recess defined in the lower face inboard of the at least one peripheral edge; and at least one trim retaining element arranged to retain an upper end portion of a trim structure when the upper end portion is fitted into the at least one recess;

wherein the lower face, the upper face, the at least one peripheral edge, the at least one recess, and the at least one trim retaining element are integrally formed of a single continuous light-transmissive material; and wherein the lens structure comprises at least one of the following features (i) and (ii):

(i) the at least one trim retaining element is disposed within the at least one recess; and (ii) the at least one trim retaining element comprises multiple trim retaining elements.

2. A lens structure according to claim 1, wherein the at least one trim retaining element is disposed within the at least one recess.

3. A lens structure according to claim 2, wherein the at least one trim retaining element comprises a radially extending post or pin arranged to fit into at least one slot defined in the upper end portion of the trim structure.

4. A lens structure according to claim 3, wherein the at least one recess defines at least one aperture extending through the upper face and arranged proximate to the at least one radially extending post or pin.

5. A lens structure according to claim 1, wherein a central portion of the lower face is circumscribed by the at least one recess, and the at least one trim retaining element is arranged in non-overlapping relationship relative to the central portion.

6. A lens structure according to claim 1, wherein the at least one trim retaining element comprises multiple trim retaining elements.

7. A lens structure according to claim 1, wherein the at least one trim retaining element comprises a first threaded surface in the recess arranged to cooperate with a second threaded surface defined along the upper end portion of the trim structure.

8. A lens structure according to claim 1, wherein the at least one trim retaining element is arranged for selective engagement with the upper end portion of the trim structure by rotation of the trim structure.

9. A lens structure according to claim 1, wherein the single continuous light-transmissive material comprises a polymeric material.

10. A lens structure according to claim 1, wherein the lower face, the upper face, the at least one peripheral edge, the at least one recess, and the at least one trim retaining element are integrally formed by injection molding.

11. A solid state downlight comprising the lens structure of claim 1, a trim structure, and at least one electrically activated solid state emitter arranged to transmit light through at least a portion of the lens structure, wherein an upper end portion of the trim structure is retained by the at least one trim retaining element.

12. A solid state downlight subassembly comprising:

a lens structure including a lower face, at least one recess defined in the lower face, and at least one trim retaining element within the recess, wherein the lens structure including the at least one trim retaining element is integrally formed of a single continuous light-transmissive material; and a trim structure comprising (i) a body including an open lower end and an open upper end, wherein the open upper end has a width that is smaller than a width of the open lower end, and (ii) at least one lens structure engaging element proximate to the open upper end;

wherein the lens structure is arranged between at least one solid state emitter of the solid state downlight and the trim structure; wherein the open upper end is arranged for insertion into the at least one recess; and wherein the at least one lens structure engaging element is arranged to removably engage the at least one trim retaining element.

13. A solid state downlight subassembly according to claim 12, wherein the at least one recess circumscribes a central portion of the lower face, the trim structure comprises a generally cylindrical portion proximate to the open upper end, and the generally cylindrical portion is arranged to substantially surround a central portion of the lower face.

14. A solid state downlight subassembly according to claim 12, wherein the at least one lens structure engaging element is arranged to removably engage the at least one trim retaining element by rotation of the trim structure.

15. A solid state downlight subassembly according to claim 12, wherein the at least one trim retaining element comprises a radially extending post or pin disposed within the at least one recess and arranged to fit at least one lens structure engaging element in the form of at least one slot defined in an upper end portion of the trim structure.

16. A solid state downlight subassembly according to claim 12, wherein the at least one trim retaining element comprises a first threaded surface, and the at least one lens structure engaging element comprises a second threaded surface.

17. A solid state downlight subassembly according to claim 12, wherein the at least one trim retaining element comprises multiple trim retaining elements, and the at least one lens structure engaging element comprises multiple lens structure engaging elements.

18. A solid state downlight comprising the solid state downlight subassembly of claim 12 and at least one electrically activated solid state emitter arranged to transmit light through at least a portion of the lens structure.

19. A solid state downlight subassembly for a solid state downlight, the subassembly comprising:

a lens structure including a lower face, an upper face, at least one peripheral edge, and at least one trim retaining element, wherein the lower face, the upper face, the at least one peripheral edge, and the at least one trim retaining element are integrally formed of a single continuous light-transmissive material; and a trim structure comprising (i) a body including an open lower end and an open upper end, wherein the open upper end has a width that is smaller than a width of the open lower end, and (ii) at least one lens structure engaging element proximate to the open upper end;

wherein the at least one trim retaining element is arranged to removably engage the at least one lens structure engaging element by rotation of the trim structure; and wherein the lens structure is arranged for placement between the trim structure and at least one solid state emitter of the solid state downlight.

20. A solid state downlight subassembly according to claim 19, wherein the at least one trim retaining element comprises a radially extending post or pin disposed within at least one recess that is defined in the lower face of the lens structure and that is arranged to fit at least one lens structure engaging element in the form of at least one slot defined in the upper end portion of the trim structure.

21. A solid state downlight subassembly according to claim 19, wherein the at least one trim retaining element comprises a first threaded surface, and the at least one lens structure engaging element comprises a second threaded surface.

22. A solid state downlight subassembly according to claim 19, wherein the at least one trim retaining element comprises multiple trim retaining elements, and the at least one lens structure engaging element comprises multiple lens structure engaging elements.

23. A solid state downlight comprising the solid state downlight subassembly of claim 19 and at least one electrically activated solid state emitter arranged to transmit light through at least a portion of the lens structure.

24. A method of fabricating the solid state downlight subassembly of claim 12, the method comprising:

arranging the at least one lens structure engaging element of the trim structure proximate with the at least one trim retaining element; and rotating the trim structure to removably engage the at least one lens structure engaging element with the at least one trim retaining element.

25. A method according to claim 24, wherein the at least one trim retaining element comprises multiple trim retaining elements, and the at least one lens structure engaging element comprises multiple lens structure engaging elements.

26. A lens structure according to claim 1, wherein the at least one trim retaining element is disposed within the at least one recess, and wherein the at least one trim retaining element comprises multiple trim retaining elements.

* * * * *